United States Patent [19]

Winberg et al.

[11] Patent Number: 4,758,933

[45] Date of Patent: Jul. 19, 1988

[54] FIREARM WITH FLASHLIGHT LOCATOR

[76] Inventors: Douglas R. Winberg, 12695 Cobbleston Creek Rd., Poway, Calif. 92064-5301; Roy A. Bohmfalk, P.O. Box 87231, San Diego, Calif. 92138

[21] Appl. No.: 876,464

[22] Filed: Jun. 20, 1986

[51] Int. Cl.[4] ..... F41G 1/34

[52] U.S. Cl. ..... 362/110; 42/71.02

[58] Field of Search ..... 362/110, 109, 111, 112, 362/190, 253; 42/1.01, 72, 71.02; D22/108

[56] References Cited

U.S. PATENT DOCUMENTS

| | | | |
|---|---|---|---|
| D. 241,836 | 10/1976 | Ruger | D22/6 |
| 257,166 | 9/1980 | Horne | 42/71.02 |
| 1,111,905 | 9/1914 | Keeran | 42/72 |
| 1,452,651 | 4/1923 | Norrlin . | |
| 1,610,092 | 12/1926 | Hise | 362/110 |
| 1,702,101 | 2/1929 | Basterreix | 362/110 |
| 1,898,368 | 2/1933 | Hess et al. | 42/71 |
| 2,109,993 | 3/1938 | Furst | 42/71 |
| 2,132,063 | 10/1938 | Whaley | 362/110 |
| 2,209,524 | 7/1940 | Key | 362/110 |
| 3,106,348 | 10/1963 | Robinson | 362/110 |
| 3,222,511 | 12/1965 | Breeding | 362/110 |
| 4,348,716 | 9/1982 | Storm et al. | 362/188 |
| 4,542,447 | 9/1985 | Quakenbush | 362/110 |

*Primary Examiner*—Ira S. Lazarus
*Assistant Examiner*—D. M. Cox
*Attorney, Agent, or Firm*—Brown, Martin, Haller & Meador

[57] ABSTRACT

A firearm such as a handgun or shotgun has a handle or grip for holding or supporting the firearm while pointing the barrel at a target. The grip has at least one groove aligned parallel to the barrel of the firearm for locating or seating a generally cylindrical object such as a flashlight or baton against the grip to allow the firearm and object to be gripped simultaneously while pointing in the same direction.

6 Claims, 2 Drawing Sheets

FIREARM WITH FLASHLIGHT LOCATOR

BACKGROUND OF THE INVENTION

The present invention relates generally to firearms and is particularly concerned with the use of flashlights or baton and the like in conjunction with firearms.

In the United States and many other countries a police officer is required to carry a flashlight, baton, and a firearm, typically a handgun or pistol. In some circumstances a rifle or shotgun will be used by an officer. Police officers in Europe and the United States are taught to fire their guns two handed, in other words using a two handed grip on the handle or handgrip of the gun. This will normally improve accuracy in aiming at a target and firing multiple shots, and reduces recoil since it is easier to hold the gun barrel steady when two hands are used for support.

During daylight hours or in well-lit areas this procedure does not normally cause any problems, but when an officer needs to aim the gun or be prepared to fire when approaching a suspect in darkened areas, it will be difficult if not impossible to aim the gun correctly while at the same time using a flashlight to illuminate the area. If the flashlight is held in one hand and the gun in the other, the officer is at a disadvantage since he will not normally have learned to aim accurately using only one hand, and also since it will be difficult to point both the flashligh and the gun accurately towards the same target.

Similar problems arise whether a rifle, shotgun or hand gun is used. Two hands are required for aiming a rifle, one holding the stock or rear grip of the rifle, and the other holding the barrel or a slide grip on the barrel. This leaves no hand free for aiming a flashlight, causing considerable problems if a rifle is needed in darkened or poorly lit conditions.

Additionally, in some situations the officer may wish to use the baton as well as the gun, for example using the baton as a firing support for the gun to improve accuracy and reduce recoil. This is also awkward to achieve and may be necessary to any time of day and under any lighting conditions.

In view of these problems various attachment devices have been proposed in the past to secure flashlights and the like to firearms, so that both hands are left free for aiming and firing the gun. One typical arrangement is shown in U.S. Pat. No. 3,106,348 of Robinson, in which a bracket detachably mounts a flashligh on a gun grip. This type of arrangement has a number of drawbacks. One major problem is the difficulty of separating the firearm and flashlight as rapidly and easily as may be desired. Another drawback is the interference of the connecting bracket with conventional two handed firing of the gun. Also, the gun with the attached bracket will not fit into a standard gun holster. The bracket adds additional weight, possibly making it more difficult to aim the gun and maintain alignment with the target in some cases. Also the bracket may be incorrectly attached or may slip, resulting in the secured flashlight pointing in the wrong direction.

In U.S. Pat. No. 2,132,063 of Whaley a flashlamp is shown secured to a gun rest having a groove for seating the barrel of a gun. In this arrangement the user grips the normal handgrip with one hand while holding the flashlamp against the barrel of the gun with the other hand. In this way the flashlamp can be used in the manner of a gunsight for aiming at a target, but this arrangement has the disadvantage that the conventional, two handed firing stance cannot be used.

SUMMARY OF THE INVENTION

It is an object of the present invention to provide an arrangement allowing the use of a firearm and flashlight or other object simultaneously while maintaining a conventional two-handed grip on the weapon.

According to the present invention a firearm is provided which comprises a barrel, frame and handgrip, and the handgrip has at least one groove extending parallel to the barrel for locating a cylindrical object with its axis parallel to the barrel. The groove is preferably shaped and dimensioned for fitting around or receiving part of the cylindrical casing of a typical flashlight. The groove is preferably of generally V-shaped cross-section, which allows it to receive objects of different diameters, and may be used for locating other cylindrical objects such as batons and the like. More than one groove may be provided, to allow the user to locate the flashlight in the most comfortable position or to enable two or more objects to be held simultaneously against the handgrip.

In one embodiment of the invention the firearm is a handgun or pistol and the or each groove is located in one of the side faces of the handgrip or in the undersurface of the grip. In an alternative arrangement the firearm is a rifle or shotgun and the groove is located in the barrel grip or slide handle on the barrel of the rifle or shotgun. Since the groove extends parallel to the barrel or bore of the gun, the flashlight held in the groove will automatically point in a direction substantially parallel to the bore of the gun and will therefore act in the manner of a sight, so that the user can aim the gun by pointing the flashlight so that it illuminates the target. Thus, not only can the target easily be illuminated while maintaining the standard two handed grip, but the gun can be aimed more easily since the barrel will automatically point in the same direction as the flashlight and will be correctly aimed onced the target is illuminated.

Thus any firearm such s a shotgun, rifle, pistol, or other long-barreled firearm can be modified to include a groove for locating a flashlight according to this invention.

BRIEF DESCRIPTION OF THE DRAWINGS

The present invention will be better understood from the following detailed description of some preferred embodiments of the invention, taken in conjunction with the accompanying drawings, in which like reference numerals refer to like parts and in which.

DESCRIPTION OF THE PREFERRED EMBODIMENTS

Figure 1:
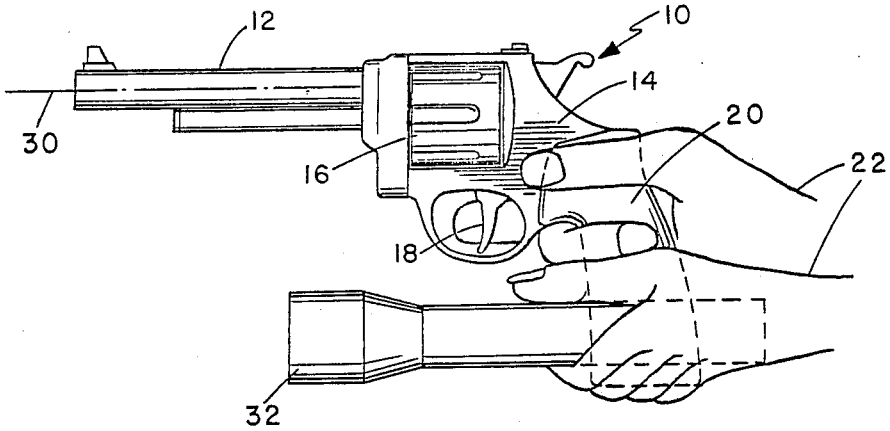
FIG. 1 is a side elevation view of a handgun having a grooved grip according to a preferred embodiment of the invention, showing a flashlight held with a two handed grip together with the handgun.
Figure 2:
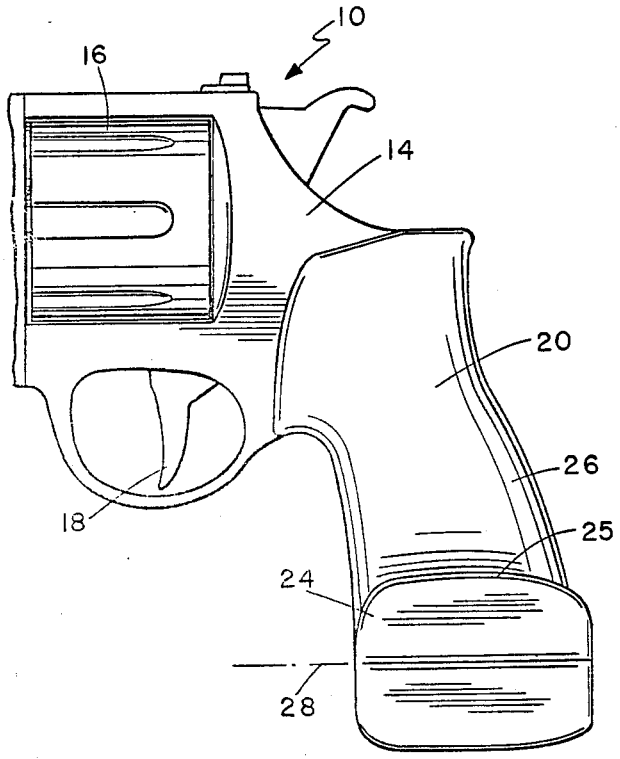
FIG. 2 is an enlarged side elevatiion view showing the grooved grip.
Figure 3:
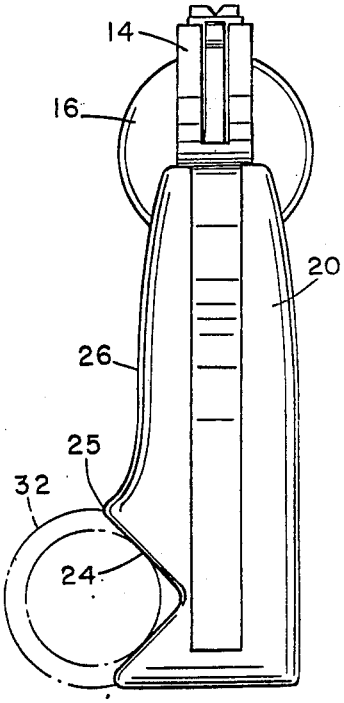
FIG. 3 is a rear elevation view of the gun showing a single grooved grip.

FIGS. 1 to 3 of the drawings illustrated a firearm 10 according to a preferred embodiment of the present invention. The firearm is basically of the handgun or pistol type generally used by police or other law enforcement officers, modified according to the invention as described in more detail below, and basically consists of the usual barrel 12 and frame 14 in which the cartridge cylinder 16 and trigger 18 are mounted. The gun has a handle or grip 20 of the general shape normally found in such firearms for gripping by one or two hands 22 when aiming the gun barrel 12 at a target.

As best seen in FIGS. 2 and 3, the grip 20 has a generally V-shaped groove 24 in one of its outer side faces 26. The groove 24 has its longitudinal axis 28 aligned with the longitudinal axis 30 of the gun barrel 12. This groove 24 is designed to locate or seat the outer cylindrical casing of a cylindrical object such as a flashlight 32, for example, as shown in FIGS. 1 and 3, or an officer's baton. When flashlight 32 is held against groove 24 while the grip 20 is clasped between two hands 22 as shown in FIG. 1, the flashlight will be automatically aligned with its axis substantially parallel to the barrel axis 30. Thus the flashlight will automatically illuminate targets in the direction in which the gun barrel points, acting in the manner of a gun sight. Preferably, a projecting lip or ridge 25 is provided along the upper edge of the groove 24, as seen in FIG. 3, to aid in locating the flashlight.

This arrangement therefore enables a substantially conventional two handed grip to be used on gun 10 while at the same time holding a flashlight which will fit against groove 24 so as to point in a direction parallel to the gun barrel and aid in aiming the gun accurately at a target in otherwise dark or poorly lit conditions.

The handle or grip may suitably be of injection molded plastics material or the like, or of any other standard gun grip materials, including composite materials, and may be identical to conventional pistol grips apart from the notch or groove 24. Clearly the groove 24 could be used to locate other cylindrical objects such as batons or billy clubs. This would enable a handgun, for example, to be used in conjunction with a baton and aligned in the manner of a shoulder rifle for substantially improved accuracy.

Figure 4:
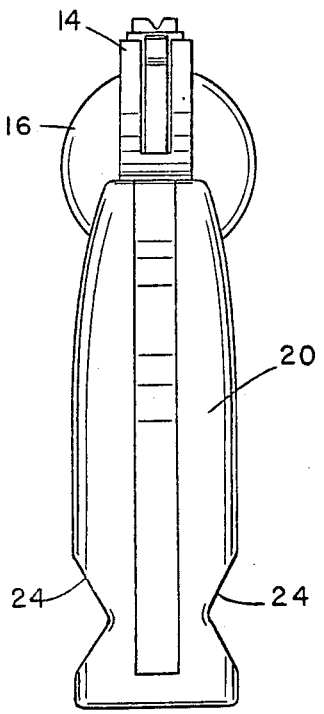
FIG. 4 is a view similar to FIG. 3 showing an alternative, double grooved grip.

FIG. 4 shows a modification in which notches or grooves 24 are provided on both outer side faces of the handgrip 20. This will allow the user to locate the flashlight or other object either against the right or left hand face of the grip 20, according to which position is more comfortable. Again the grooves 24 are of generally V-shaped cross-section, which allows cylindrical objects of various diameters to be located or seated in the groove. The two grooves 24 may, in another modification, be of different angles and depths, to allow an even larger range of different diameter objects to be selectively located in the appropriate groove.

Figure 5:
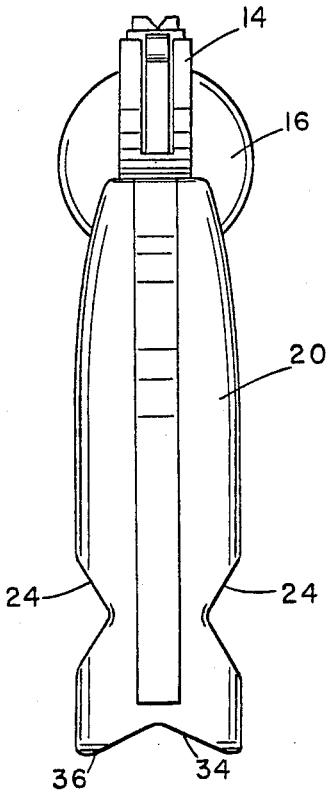
FIG. 5 is another view similar to FIG. 3 showing a triple grooved grip.

FIG. 5 shows another modification in which a total of three grooves are provided in the grip 20. The grooves all comprise generally V-shaped indentations and include oppositely directed grooves 24 on the outer side faces of the grip 20, and an additional groove 34 in the bottom face 36 of the handle. All the grooves have their longitudinal axes aligned with the gun barrel axis, and in the embodiment shown in FIG. 5 the lower or bottom groove 34 is wider than the two side grooves 24. Thus the bottom groove can be used for seating larger diameter objects, such as larger, higher power flashlights, for example.

The multi-grooved handgrips can be used to locate one or more objects parallel to the barrel simultaneously and against any chosen face of the handgrip. The grooves will accept or seat various cylindrical objects of different diameters, such as any size of flashlight or police baton. Thus, whereas up to now a police officer having a flashlight or baton in one hand will only have one hand free for controlling and aiming his gun, the handgrip of this invention enables the user to grip the handgun and a flashlight or the like simultaneously with the standard two handed grip and at the same time will point the light beam in substantially the same direction as the gun barrel, enabling relatively accurate target aiming and illumination.

Figure 6:
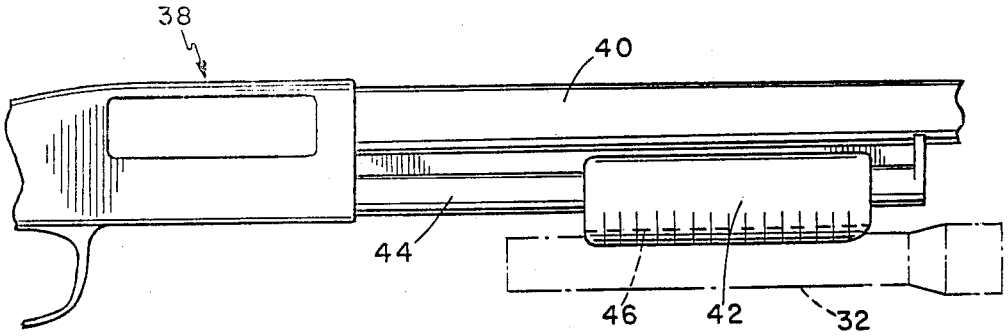
FIG. 6 is a side elevation view of a portion of a shotgun or rifle according to another embodiment of the invention having a grooved slide grip shown locating a flashlight.

FIG. 6 shows an alternative embodiment of the invention for allowing cooperation of a flashlight with a shotgun or rifle 38. A rifle is conventionally held with one hand gripping the rear handle or grip (not shown) and the other hand gripping the barrel 40 to steady and aim it. The barrel 40 may have a slide handle 42 as shown in FIG. 6 slidably mounted on magazine tube 44, and the user will grip handle 42 to aim the barrel. In the arrangement shown in FIG. 6 the slide handle or grip 42 is provided with an elongate, downwardly facing groove 46 along its length which extends parallel to the barrel 40. The groove is of generally V-shaped cross-section as in the previous embodiment and will locate a cylindrical object such as a flashlight 32 as shown in FIG. 6 with its axis parallel to the barrel. Thus the flashlight will illuminate an area directly in the line of sight of the rifle in an equivalent manner to a gun sight or telescopic sight while allowing the user to maintain a substantially conventional grip on the rifle.

Although the groove 44 is shown in a sliding handle in FIG. 6, clearly such a groove could be provided in any rifle or shotgun barrel in the area normally gripped by the user, regardless of whether a special handgrip is provided. If a handgrip is present on the barrel, the groove will be formed in the outer face of the handgrip.

Thus the modified handgrip of this invention both allows a flashlight or other cylindrical object to be held easily and naturally within a standard gun gripping stance, and automatically orients the object parallel to the gun barrel to aid in aiming the gun. No additional securing devices or brackets are required, making separation of the gun and flashlight, for example, quick and easy and allowing the use of standard holsters and gun storage racks.

Although some preferred embodiments of the invention have been described above by way of example, it will be understood by those skilled in the field that modifications may be made to the disclosed embodiments without departing from the scope of the invention, which is defined by the appended claims.

We claim:

1. A firearm, comprising:

a barrel;

a handgrip for holding the firearm to direct the barrel at a target, the handgrip comprising a body of conventional handgun shape and dimensions having outer side faces for gripping by one or two hands of a user, and a lower face;

the handgrip having a single groove in at least one of its side faces, the groove comprising flashlight locating means for locating and seating a flashlight while simultaneously gripping the handgrip, the groove being orientated to extend parallel to the longitudinal axis of the barrel for directly seating at least part of the outer cylindrical surface of a flashlight freely within the groove with the longitudinal axis of the flashlight parallel to said barrel axis, the groove comprising a generally V-shaped indentation with a depth equal to at least ¼ of the handgrip thickness between the side faces, and comprising means for seating at least part of the outer cylindrical surface of a flashlight while gripping the handgrip with the flashlight held against the groove without positively securing the flashlight to the handgrip.

2. The firearm as claimed in claim 1, wherein the firearm has a single groove in each of its outer side faces, said grooves comprising means for selectively locating a flashlight against either side groove while aiming the firearm, each groove extending parallel to the gun barrel.

3. The firearm as claimed in claim 2, wherein the handgrip has a lower face, and has a further, bottom groove located in said lower face and extending parallel to the gun barrel.

4. The firearm as claimed in claim 3, wherein the bottom groove is of different dimensions to the side grooves for locating cylindrical objects of different sizes.

5. The firearm as claimed in claim 1, wherein the handgrip is of plastic material.

6. The firearm as claimed in claim 1, wherein the groove has an outwardly projecting lip extending along its upper edge.

* * * * *